US010920431B2

(12) United States Patent
McNinch

(10) Patent No.: US 10,920,431 B2
(45) Date of Patent: Feb. 16, 2021

(54) DRAIN AND VENT COVER

(71) Applicant: David K. McNinch, Alvarado, TX (US)

(72) Inventor: David K. McNinch, Alvarado, TX (US)

( * ) Notice: Subject to any disclaimer, the term of this patent is extended or adjusted under 35 U.S.C. 154(b) by 88 days.

(21) Appl. No.: 16/231,629

(22) Filed: Dec. 24, 2018

(65) Prior Publication Data

US 2019/0194953 A1 Jun. 27, 2019

Related U.S. Application Data

(60) Provisional application No. 62/610,289, filed on Dec. 26, 2017.

(51) Int. Cl.
*E04F 17/02* (2006.01)
*E04D 13/08* (2006.01)

(52) U.S. Cl.
CPC ..... *E04F 17/026* (2013.01); *E04D 13/08* (2013.01); *E04D 2013/0806* (2013.01); *E04D 2013/0866* (2013.01)

(58) Field of Classification Search
CPC ..... E04D 13/08; E04D 2013/0806; E04D 2013/0866
USPC ..... 138/96 R
See application file for complete search history.

(56) References Cited

U.S. PATENT DOCUMENTS 2,976,796 A * 3/1961 Anthony ..... F23L 17/02 454/14
3,797,181 A * 3/1974 Nievelt ..... E04D 13/1476 52/105
4,920,867 A * 5/1990 Joly ..... F23J 13/08 454/12
5,960,972 A * 10/1999 Larguia, Sr. ..... B65D 41/18 215/253
5,992,660 A * 11/1999 Miura ..... B65D 51/002 215/247
6,092,658 A * 7/2000 Pietrafesa ..... B65D 81/365 206/457
6,152,817 A * 11/2000 Daniels ..... F23L 17/12 454/12
2008/0295418 A1* 12/2008 Edell ..... E04D 13/08 52/16
2011/0203191 A1* 8/2011 Argentina ..... E04D 13/0645 52/12
2011/0232766 A1* 9/2011 Bell ..... E04D 13/08 137/1

(Continued)

*Primary Examiner* — Craig M Schneider
*Assistant Examiner* — David R Deal
(74) *Attorney, Agent, or Firm* — Wilson Daniel Swayze, Jr.

(57) ABSTRACT

The present invention relates to a cover assembly for a drain and vent pipe. The cover assembly comprises an attaching component, a slide latch, a screen wire, a gasket and multiple tooth configuration. The attaching component is positioned between the screen wire and the slide latch. The screen wire is detachable from the attaching component, thereby enabling easy cleaning and replacement of the screen wire. The slide latch includes the gasket made of silicone rubber, which is extruded into a mold into which the multiple tooth are placed. The multiple tooth grips to an outer surface of the drain or vent pipe, and prevents the cover assembly from sliding off during use. The slide latch is attached to the attaching component at one end and to an outer surface of the drain or vent pipe on the other end.

9 Claims, 10 Drawing Sheets

(56) References Cited

U.S. PATENT DOCUMENTS

| | | | | |
|---|---|---|---|---|
| 2013/0118625 | A1* | 5/2013 | Bell | F16L 9/006 138/37 |
| 2013/0330127 | A1* | 12/2013 | DeLoach | E04D 13/08 405/80 |
| 2017/0211277 | A1* | 7/2017 | Kerr | B01D 29/05 |

* cited by examiner

DRAIN AND VENT COVER

BACKGROUND OF THE INVENTION

A. Technical Field

The present invention generally relates to cover for drain and vent pipes. More specifically, the present invention relates to a cover assembly adapted to be installed over the drain pipes, vent pipes or the like of any diameter.

B. Description of Related Art

Generally, drain pipes used in a commercial, industrial and residential building extend through a wall of the building and outwardly of the wall at some point allowing condensed water, overflow rainwater, or the like, to drain outwardly from the drain pipe. The systems in the structure such as water heaters, HVAC systems, sewer, water, drainage and many other systems requires constant monitoring and maintenance. Further, construction of building and home require internal systems with adequate drain and venting systems. It is common for the drain and venting systems, when installed, not to have adequate protection from the incursion of debris, any way of preventing animals, or other pests from entering the vent and drain systems. Exterior HVAC drains, vents, roof vents, gutters, are all susceptible to entry of foreign objects, animals, and insects. Further, untold amounts of damage and hassle are caused by debris and creatures entering into the opening of a system required for the proper function of a building.

The lack of protection for these venting and draining systems causes enormous amounts of damage to structures and internal systems of the buildings. Roof vents and pipes allow the exit of gases into the atmosphere helping in maintaining the internal systems of the buildings. Chimneys are susceptible to entry by animals, especially birds such as the chimney swallows or swifts. The chimney swallows or swifts are particularly notorious for nesting in chimneys and along with them come the nesting materials that could become fire hazards. Additionally, clogs in the roof vents and pipes are common phenomena, which occur due to the leaves fallen or dropped continuously into the roof vents or pipes from various trees such as such as *magnolia*, pines or other non-deciduous species. It is therefore required that the roof vents to be cleaned and maintained for proper functioning of the internal systems of the buildings.

The vent and drain pipes are used as a place of shelter by birds and various animals, hence build their nest in the opening of the vent and drain pipes, as these animals are in need of a warm convenient place. However, such activities of the birds and the animals creates a problem for unprotected structures. It has been seen that, dead birds, squirrels, rats and many other varieties of animals are often the cause for expensive failures of HVAC equipment, sewer systems, drainage and other systems that have exterior venting or drains. Further, insects although tiny creatures could be very harmful to the vent and the drain pipes. The size of the insect being small, and their ability to reproduce rapidly area could damage the drain and the vent pipe, therefore the building and homeowners must continuously work to eliminate the ants from the drain pipe and the vent pipe, which is a tiresome and time consuming job.

Currently, the sewer vent pipes exiting from the roof of the dwelling and the downspouts extending down from the gutters in the building have open ends. The pipes with open ends are clogged as small animal or insect use this pipe as a shelter, and could build homes within, preventing the designed use of the pipes. Further, see through of the opaque downspouts and the vent pipes are not passible, resulting in a difficult cleaning process. In the downspout case, snakes, birds, squirrels, ants, spiders, and other insects could make homes, which is washed out by rain. This could expose to people living in the home to dangerous conditions, especially if they are unaware that the insects or animals are residing at the open ends of the downspout pipe.

Therefore, there is a need for a solution that protects the internal systems of home and buildings keeping the drain and the vent pipe free from blockage and pests. Further, there is a need of a protective cover for the drain and vent pipe, which could be easily replaced and cleaned.

SUMMARY OF THE INVENTION

The present invention relates to a cover assembly for a drain or a vent pipe. The cover assembly is configured to prevent the entry of unwanted pests into homes or buildings via a drain pipe or a vent pipe. More particularly, the cover assembly is ease to be installed in the drain and vent pipe.

In an embodiment, the cover assembly of the present invention is a protective unit preventing the entry of pest and debris in the drain and vent pipe. The cover assembly is available in a variety of forms designed to fill the particular need of homeowners and building owners. In an embodiment, the cover assembly comprises an attaching component, a screen wire, a slide latch, a gasket, and one or more teeth. The cover assembly comprises of an upper section and a lower section. The upper section includes the attaching component, and the screw wire. The lower section includes the slide latch, the gasket, and the one or more teeth or multiple tooth assembly. In one embodiment, the cover assembly is circular or square in structure. The cover assembly could be of any shape and size based on the shape and size of the drain pipe or the vent pipe. In one embodiment, the slide latch comprises a first end adapted to extend at least partially over the drain pipe, or vent pipe. The attaching component of the cover assembly is made of plastic material such as polyvinyl chloride (PVC). The attaching module comprises a first end coupled to a second end of the slide latch. The attaching module further comprises a second end adhesively attached to the screen wire. In one embodiment, the slide latch comprises a hollow body in fluid communication with at least one of the drain pipe, or vent pipe. In one embodiment, the attaching component is in fluid communication with the slide latch. The screen wire could be easily detached from the attaching module for cleaning or replacement. The screen wire prevents the entry of pests and debris into the drain pipe or the vent pipe. The slide latch includes the gasket made of silicone rubber, which is extruded into a mold into which the multiple tooth are placed. The multiple tooth grips to an outer surface of the drain or the vent pipe such that the cover assembly do not slide off during regular use. The multiple tooth assembly enables the cover assembly to be pushed onto the drain pipe.

In one embodiment, the cover assembly having square structure is used in a downspout model or downspout pipe. In an embodiment, the attaching component is made of EVA foam. In another embodiment, the cover assembly having circular structure is used in sewer vent pipe. The attachment component of the cover assembly is made of PVC. The screen wire of 12-mesh screen is cut to shape using a water jet-machining center and then folded into shape. After shaping, the edges of the screen wire are spot welded to make a rigid assembly. Further, the welded screen is shot peened and chemically passivated. The screen wire is adhesively attached to the attaching component using high-energy waterproof adhesive.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1A:
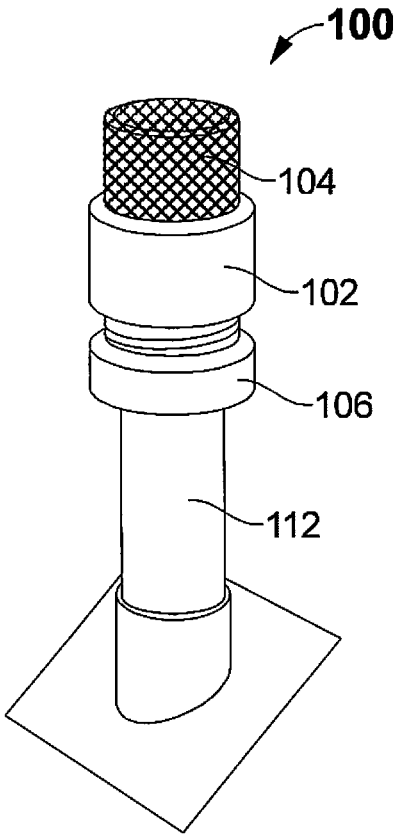
FIG. 1A is a perspective view of a cover assembly installed on a sewer vent pipe according to an embodiment of the present invention.
Figure 1B:
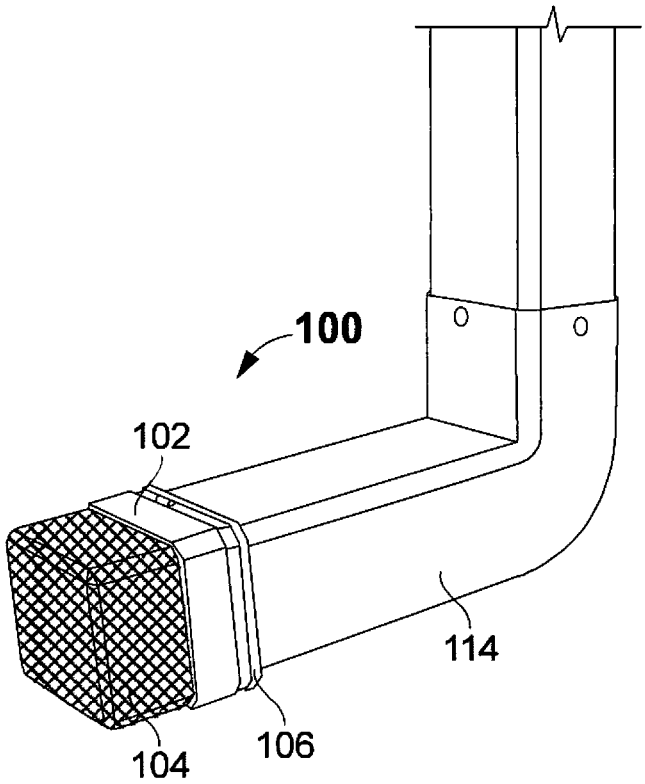
FIG. 1B is a perspective view of the cover assembly installed on a downspout pipe, according to an embodiment of the present invention.

Referring to FIG. 1A is a perspective view of the cover assembly 100 installed on a sewer vent pipe 112 according to an embodiment of the present invention. The cover assembly 100 is configured to prevent the entry of unwanted pests into homes or buildings via downspout pipe 114112 or a vent pipe 112. The cover assembly 100 is available in a variety of forms designed to fill the particular need of homeowners and building owners. In an embodiment, the cover assembly 100 comprises an attaching component 102, a screen wire 104, a slide latch 106, a gasket 108 and one or more teeth, multiple tooth or shark bite connectors 110. The cover assembly comprises of an upper section and a lower section. The upper section includes the attaching component 102 and the screw wire 104, and the lower section includes the slide latch 106, the gasket 108 and the one or more teeth or multiple tooth or shark bite connectors 110. In one embodiment, the cover assembly 100 is circular or square in structure. The cover assembly 100 could be of any structure that could fit rigidly to the sewer pipe 112 or the downspout pipe 114. Referring to FIG. 1B is a perspective view of the cover assembly 100 installed on the downspout pipe or downspout model 114 according to an embodiment of the present invention.

Figure 2A:
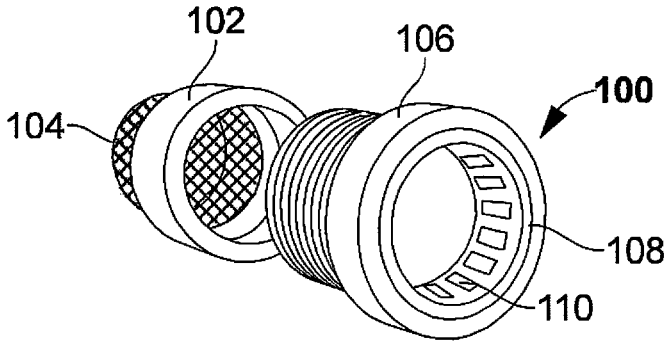
FIG. 2A is an exploded view of an attaching component, and a slide latch of the cover assembly having a circular structure, according to an embodiment of the present invention.

Referring to FIG. 2A is an exploded view of the attaching component 102, and the slide latch 106 of the cover assembly 100 having the circular structure, according to an embodiment of the present invention. In one embodiment, the cover assembly 100 is circular in structure. The cover assembly 100 is assembled with an opening to fit a 2", 3", or a 4" circular vent stack. In one embodiment, the attaching component 102 is an intermediate region of the cover assembly 100. In one embodiment, the slide latch 106 comprises a first end adapted to extend at least partially over the downspout pipe 114, or sewer vent pipe 112. The attaching component 102 comprises a first end coupled to a second end of the slide latch 106. The attaching component 102 further comprises a second end adhesively attached to the screen wire 104. The slide 106 is positioned closer to the drain pipe, whereas the screen wire 104 is positioned away from the drain pipe. In one embodiment, the slide latch 106 comprises a hollow body in fluid communication with at least one of the downspout pipe 114, or sewer vent pipe 112. In one embodiment, the attaching component 102 is in fluid communication with the slide latch 106.

In one embodiment, the attaching component 102 is made of plastic material. The plastic material is but not limited to PVC (polyvinyl chloride). The attaching component 102 is subjected to a machining operation in a CNC milling center. After the machining operation, the screen wire 104 is inserted into the attaching component 102. The screen wire 104 is adhesively bonded to the attaching component 102 to make the upper section of the cover assembly 100. An inner surface of the attaching component 102 has threads or a threaded interior portion, which couple or mate with threads present on an outer surface of the slide latch 106 or a threaded exterior portion.

In one embodiment, the slide latch 106 is made of plastic material such as but not limited to PVC (polyvinyl chloride). The slide latch 106 is subjected to a machining operation in a CNC milling center. In an embodiment, the slide latch 106 is made in two tooth sizes such as ¾" and 1" application while the other is much larger for use on the downspout pipe.

In an embodiment, the slide latch includes the gasket 108, and the multiple tooth 110 configuration. The gasket 108 is extruded into a mold into which the multiple teeth 110 are placed. In one embodiment, the gasket 108 is made of rubber material such as but not limited to silicone. The rubber material used for making the gasket 108 is very tough, could withstand over 500° F. continuously. Further, the rubber material is highly resistant to chemicals and water immersion, and is used in this type of application. In one embodiment, the silicone rubber material could be supplied in almost any vibrant color. A distinctive color could be chosen to enhance the product recognition factor of the cover assembly 100, for improving the market adoption of the cover assembly 100. In another embodiment, the gasket 108 is configured to hold the multiple tooth 110 making a continuous ribbon of stainless steel toothed high temperature rubber gasket 108. The rubber-toothed strip is cut to length to fit in a channel in the slide latch 106. The rubber-toothed strip is adhesively bonded into place using waterproof adhesive. In another embodiment, the slide latch 106 is easy to slip onto the downspout pipe 114 or sewer vent pipe 112. The slide latch once installed is firmly secure onto the downspout pipe 114 or sewer vent pipe 112, because the multiple tooth 110 dig into the surface of the downspout pipe 114, or sewer vent pipe 112.

Figure 2B:
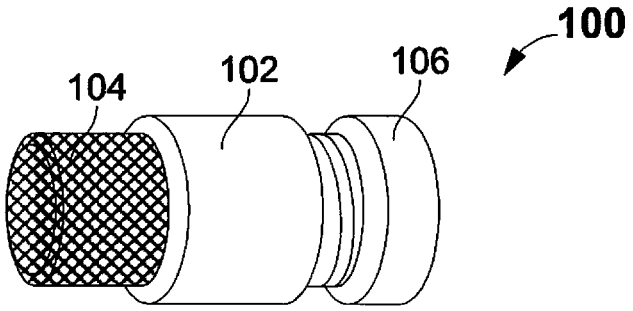
FIG. 2B exemplary illustrates installation of the slide latch into the attaching component, according to an embodiment of the present invention.

In an embodiment, the screen wire 104 is cut to a required shape using a water jet-machining center, and then folded into shape. After shaping, the edges of the screen wire 104 are welded to make a rigid assembly. The welded screen wire 104 is shot peened and chemically passivated. The screen wire 104 is dried upon passivation process. The screen wire 104 is inserted into the attaching component 102 after the passivation process. The screen wire 104 is adhesively bonded in place using high-energy waterproof adhesive. In one embodiment, the screen wire 104, and the attaching component 102 undergoes fabrication process. The screen wire 104 and the attaching component 102 is screwed onto the slide latch 106. In an embodiment, the screen wire 104 with 12-wire material could be replaced with 16-wire material for the vent stack products. The screen wire 104 with 16 wire material size is able to stop even 'no-see-ums' from infiltrating, while maintaining the capabilities of the vent stack design without significant degradation. FIG. 2B exemplary illustrates installation of the slide latch 106 in the attaching component 102, according to an embodiment of the present invention.

Figure 3A:
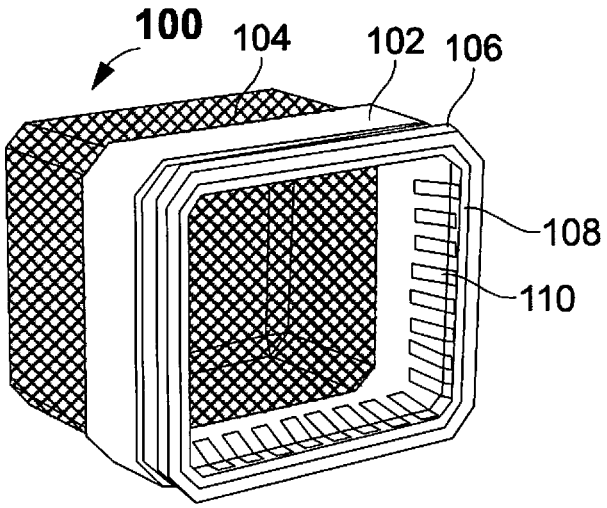
FIG. 3A is a perspective view of the cover assembly having a square structure, according to an embodiment of the present invention.

FIG. 3A is a perspective view of the cover assembly 100 having the square structure according to an embodiment of the present invention. In an embodiment, the cover assembly 100 is molded with an opening to fit either a 2" by 3" or a 3" by 4" square downspout. In an embodiment, the cover assembly 100 having square structure is used for a downspout model. In an embodiment, the attaching component 102 is manufactured using ethylene vinyl acetate (EVA) foam. The EVA foam has a very dense exterior on the outer surface of the molding and a slightly less dense interior surface that allows some compression so it will fit over almost all downspouts, regardless of condition. The EVA foam has a channel molded in it to accept the slide latch 106. The slide latch 106 is adhesively bonded into the attaching component 102. The attaching component 102 and the slide latch 106 compress to provide an optimum fit on the variable smoothness of a downspout surface. The screen wire 104 is bonded to one end of the attaching component 102. In one embodiment, an additional clamp could be reinforced using worm gear band clamp at the base of the attaching component 102.

In an embodiment, the slide latch 106 of the cover assembly 100, having square configuration is cut to length. The slide latch 106 is then adhesively bonded into a cavity milled in the attaching component 102. The slide latch 106 is made of plastic material such as but not limited to PVC. The slide latch 106 includes the gasket 108 and multiple tooth 110. The materials and the method or process used in the manufacture of the slide latch 106, the gasket 108 and multiple tooth 110 is same as described in FIG. 2A.

Figure 3B:
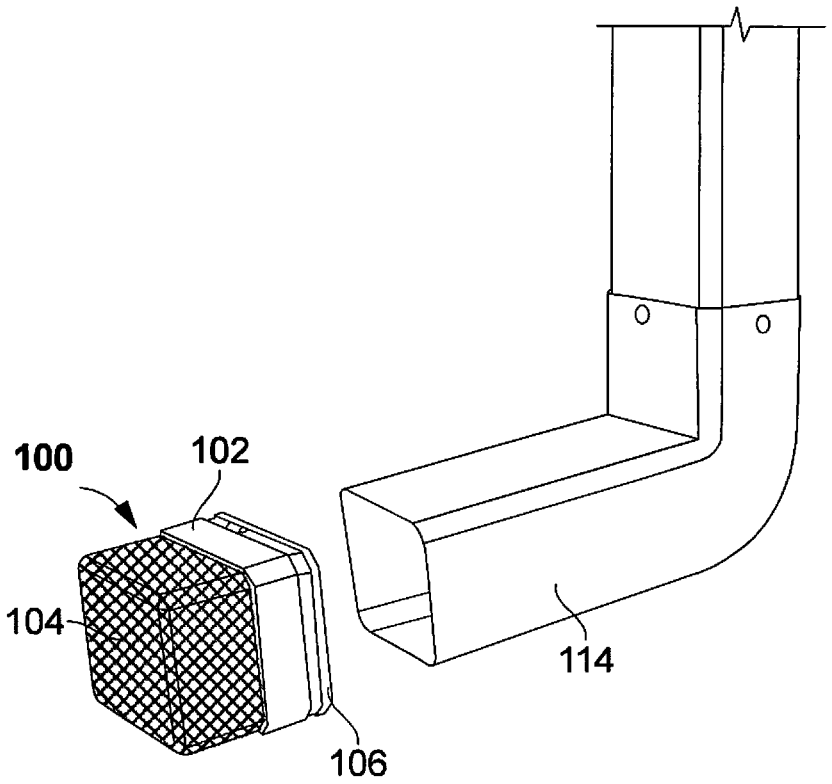
FIG. 3B is an exploded view of the cover assembly having the square structure, and the downspout pipe according to an embodiment of the present invention.

In an embodiment, the screen wire 104 is fabricated using 12 wire per inch, type 316 stainless steel wire. The screen wire 104 is woven using 0.023" diameter wire, making a 0.083" on center grid. This provides an opening of 0.063 inches, which is smaller than most insects and all animals. The stainless steel screen wire 104 is highly resistant to corrosion and rust. The screen wire 104 is cut to shape using a water jet-machining center, and then folded into shape. After shaping, the edges are spot welded to make a rigid assembly. After assembly, the welded screen wire 104 is shot peened and chemically passivated. After drying, the screen wire 104 is inserted in the attaching component 102, and adhesively bonded in place using high-energy waterproof adhesive. The screen wire 104 allows easy passing of water or sewer gases, preventing any insects from entering the downspout pipe 114. The screen wire 104 could be removed to dump out any accumulated gutter debris and then reinstalled, where it remains securely in place. FIG. 3B is an exploded view of the cover assembly 100 having the square structure and the downspout pipe 114 according to an embodiment of the present invention.

Figure 4A:
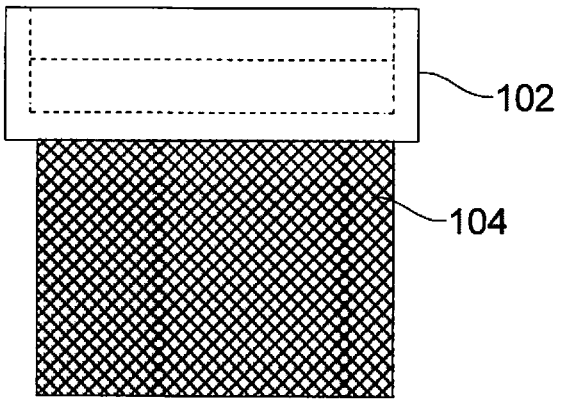
FIG. 4A is a side view of the cover assembly having the square structure according to an embodiment of the present invention.

FIG. 4A is a side view of the cover assembly 100 having the square structure according to an embodiment of the present invention. In an embodiment, the cover assembly 100 having the square structure is used in the downspout model or pipe 114 for preventing the entry of debris. In an embodiment, the screen wire 104 is fabricated using number 12 stainless steel wire with 0.023" diameter wire on 0.083" centers. The screen wire 104 is secured in the attaching component 102 using a waterproof adhesive. Accumulation of any debris from the gutters could be removed off from the screen wire 104 by detaching the screen wire 104 from the attaching component 102. The screen wire 104 could be replaced whenever required, wherein the attaching component 102 and the components of the lower section of the cover assembly 100 remain secured to the downspout pipe 114. In one embodiment, the attaching component 102 of the cover assembly 100 is reinforced using a worm gear band clamp. The stainless steel teeth 110 retain their grip on the outer surface of the downspout pipe 114, over a large number of remove/restore cycles of the screen wire 104. FIG. 4C is a side view of the cover assembly 100 installed in the downspout pipe 114.

Figure 4B:
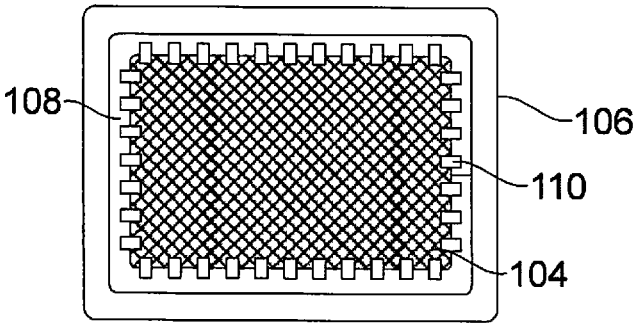
FIG. 4B is a bottom view of the cover assembly having the square structure according to an embodiment of the present invention.
Figure 4C:
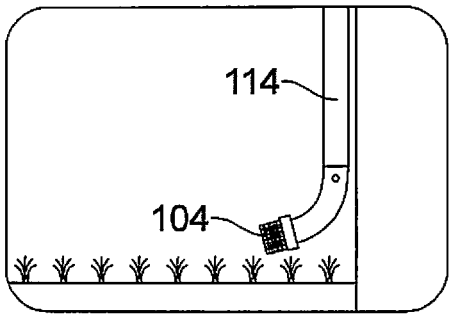
FIG. 4C is a side view of the cover assembly installed in the downspout pipe, according to an embodiment of the present invention.
Figure 4D:
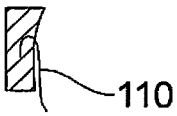
FIG. 4D is a cross-sectional view of the slide latch along the line A-A' of FIG. 4E.
Figure 4E:
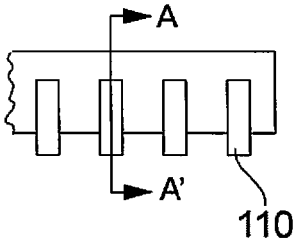
FIG. 4E is a side view of the latch of the cover assembly, according to an embodiment of the present invention.

FIG. 4B is a bottom view of the cover assembly 100 having the square structure according to an embodiment of the present invention. In an embodiment, the compression lock stainless steel teeth bite 110 into the slide latch 106 slides over and prevents the cover assembly 100 from sliding off when in use. Further, the gasket 108 seals against the surface of the slide latch 106, over which it is slipped, preventing leaks. The screen wire 104 prevents the insects and animals from creeping up into the downspout pipe or drain pipe 114, and clogging it up with nests. FIG. 4D is a cross-sectional view of the slide latch 106 along the line A-A' of FIG. 4E. In an embodiment, the slide latch 106 is molded into the silicone rubber gasket material 108, and multiple tooth 110 grasp onto the outer surface of the downspout pipe 114 preventing slipping off during use. The multiple tooth 110 enables the cover assembly 100 to be pushed onto the drain pipe FIG. 4E is a side view of the latch 106 of the cover assembly 100.

Figure 5A:
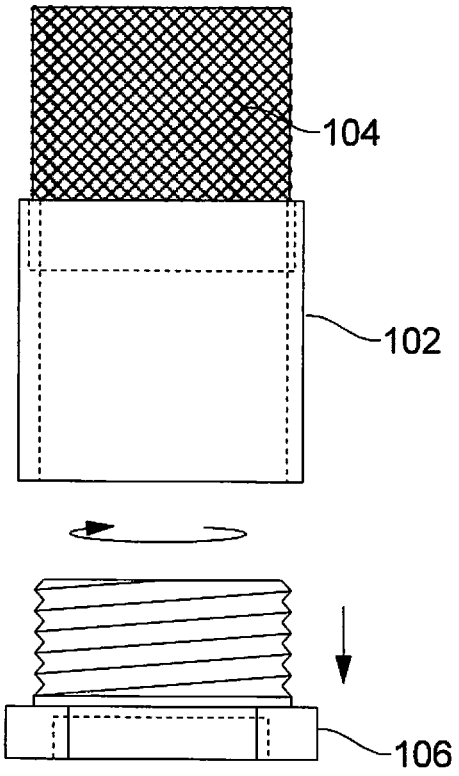
FIG. 5A is a side view of the s attaching component comprising threaded region to receive the slide latch, according to an embodiment of the present invention.

FIG. 5A is a side view of the attaching component 102 comprising the threaded exterior portion to receive the slide latch 106, according to an embodiment of the present invention. In an embodiment, the cover assembly having circular structure is used in the sewer vent model or in the sewer vent pipe 112. The lower section of the cover assembly 100 is milled out of a standard bushing using a CNC milling center. The stainless steel screen wire 104 is cut to size, rolled to shape, and then spot-welded to make the screen wire 104 insect tight. The screen wire 104 is slipped into a milled cavity in the attaching component 102, and then adhesively bonded into place. After fabrication, the attaching component 102 is screwed onto the milled slide latch 106 to join the 2 components i.e. the upper section and the lower section of the cover assembly 100. The slide latch 106 is cut to length, and adhesively bonded into the cavity milled in a base of the attaching component 102.

Figure 5B:
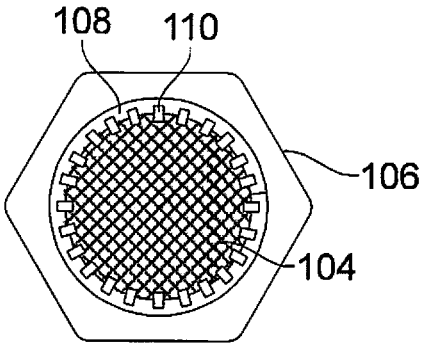
FIG. 5B is a bottom view of the cover assembly having the circular structure, according to an embodiment of the present invention.

FIG. 5B is a bottom view of the cover assembly 100 having the circular structure, according to an embodiment of the present invention. In an embodiment, the cover assembly 100 is used on 2", 3", and 4" diameter vents exiting the roof to prevent insects, small animals, and airborne debris from getting into the vent stacks. In one embodiment, a small version of the cover assembly 100 is supplied to fit on ¾" and 1" water heater safety discharge piping. The cover assembly 100 is slipped over the sewer vent pipe 112 and pressed down firmly so that the slide latch 106 and the gasket 108 is secured firmly to the sewer vent pipe 112.

In an embodiment, the cover assembly 100 could be made using stainless steel sheet metal, the slide latch 106, and the stainless steel screen wire 104, which is spot-welded to the metal sheet metal. The cover assembly 100 is manufactured in round and rectangular configuration or structure that fit standard fireplace chimneys and flues. In another embodiment, the cover assembly 100 could be of any shape depending on the size and shape of the drain pipe and the vent pipe. The cover assembly 100 helps in keeping the insects and animals out while keeping flaming embers in.

In an embodiment, cover assembly 100 is designed to protect a property owner from the unwanted intrusion into structures by a variety of animals, insects or debris. The cover assembly 100 could be cleaned and replaced easily, and hence last for many years protecting the home and business structures from damage and inconvenience of repairs. Additionally, the screen wire 104 of the cover assembly 100 enables an easy exit of the liquid and gases preventing any incursion into the drain or gutter from the outside. The screen wire 104 is detachable from the attaching component 102, hence the screen wire 104 could be cleaned and replaced easily. The cover assembly 100 keeps the building or home and its systems safe and free from blockage, pests and rain gutter downspout. In one embodiment, the cover assembly 100 is a weatherproof and UV proof. Further, a metal version of the cover assembly 100 could also be designed for chimneys and fireplaces. The cover assembly 100 is available in variety of sizes and in vibrant colors. In another embodiment, wireless capability options are also available for smart homes.

Preferred embodiments of this invention are described herein, including the best mode known to the inventors for carrying out the invention. It should be understood that the illustrated embodiments are exemplary only, and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A drain and vent cover, comprising:

a slide latch comprising a first end adapted to extend at least partially over at least one of a drain or a vent opening;

an attaching component comprising a first end coupled to a second end of the slide latch, and a wire screen disposed to cover a second end of the attaching component, wherein the slide latch comprises a hollow body in fluid communication with the at least one of the drain or the vent opening, wherein the attaching component is in fluid communication to the slide latch, and wherein the wire screen allows exhaust of waste from the drain or the vent opening and prevents entry of foreign matter into the drain or the vent opening, further comprising a gasket at an interior side of the first end of the slide latch.

2. The drain and vent cover of claim 1, wherein the gasket comprises a plurality of tooth.

3. The drain and vent cover of claim 1, wherein the gasket is made of rubber.

4. The drain and vent cover of claim 2, wherein the plurality of tooth is made of stainless steel.

5. The drain and vent cover of claim 1, wherein a gasket and a tooth are configured to secure the cover to at least one of the drain or vent opening.

6. The drain and vent cover of claim 1, wherein the second end of the slide latch comprises a threaded exterior portion.

7. The drain and vent cover of claim 1, wherein the first end of the attaching component comprises a threaded interior portion adapted to mate with the threaded exterior portion of the slide latch.

8. The drain and vent cover of claim 1, wherein the wire screen is secured to the attaching component using a waterproof adhesive.

9. The drain and vent cover of claim 1, wherein the wire screen is made of stainless steel.

* * * * *